United States Patent [19]

Diethorn

[11] 4,146,997

[45] Apr. 3, 1979

[54] DOMICAL-TYPE STRUCTURE

[75] Inventor: Lionel J. Diethorn, Belle Vernon, Pa.

[73] Assignee: M. Ted Raptes, Arlington, Va.

[21] Appl. No.: 828,484

[22] Filed: Aug. 29, 1977

Related U.S. Application Data

[63] Continuation-in-part of Ser. No. 399,253, Sep. 20, 1973, abandoned.

[51] Int. Cl.[2] ..... E04B 1/32; E04B 7/08

[52] U.S. Cl. ..... 52/81; 52/236.2

[58] Field of Search ..... 52/80, 81, 82, 236.2; D25/13, 32

[56] References Cited

U.S. PATENT DOCUMENTS

| | | | |
|---|---|---|---|
| 2,918,992 | 12/1959 | Gelsavage | 52/81 |
| 2,934,075 | 4/1960 | Richardson et al. | 52/2 |
| 3,004,542 | 10/1961 | Moody | D25/32 |
| 3,094,708 | 6/1963 | Caldwell | 52/81 X |
| 3,114,176 | 12/1963 | Miller | 52/81 |
| 3,203,144 | 8/1965 | Fuller | 52/81 |
| 3,344,565 | 10/1967 | Nye | 52/81 |
| 3,359,694 | 12/1967 | Hein | D25/13 |
| 3,530,621 | 9/1970 | Rutzebeck | 52/81 |
| 3,740,903 | 6/1973 | Ahern | 52/81 |

FOREIGN PATENT DOCUMENTS

| | | | |
|---|---|---|---|
| 601795 | 7/1960 | Canada | 52/81 |
| 896836 | 4/1972 | Canada | 52/80 |
| 1331238 | 5/1963 | France | 51/81 |
| 1818 | 12/1916 | Netherlands | 52/81 |

OTHER PUBLICATIONS

Industrial Design, p. 79, Oct. 1959.

*Primary Examiner*—Leslie Braun
*Attorney, Agent, or Firm*—James C. Wray

[57] ABSTRACT

The invention relates to a dome-type structure constructed from four basic triangular structural units. Each basic unit is an isosceles triangle which has predetermined angular edges. The four units are interrelated in their dimensional sizes and angular edges. The several units are installed in four circular tiers whereby abutting adjacent units fit together properly, and whereby upper tiers are canted inwardly to enclose the structure. The structure requires no internal support members. The radius of the circular base is greater than the height of the structure.

6 Claims, 11 Drawing Figures

DOMICAL-TYPE STRUCTURE

BACKGROUND OF THE INVENTION

This application is a continuation-in-part of copending application Ser. No. 399,253 filed Sept. 20, 1973 now abandoned.

This invention relates to a building structure generally having a domical shape which has a radius at the base greater than the height at the center. It is constructed of four basic structural units, each of which is an isosceles triangle. The basic units are arranged in circular symmetrical tiers. Circular tiers or rows comprise combinations of the basic units in a symmetrical pattern.

Prior art structures constructed as domes usually comprise a number of individual large basic structural units such as hexagons, etc. Because of this, erection of the structure requires that the structural units be exact in their various geometric dimensions in order that all the elements can be fit together properly. Thus, if a unit has incorrect dimensions, difficulty is encountered during construction. Furthermore, prior art dome structures are generally true hemispheres wherein the radius of the base is equal to the height at the center of the dome. A hemispherical dome has two drawbacks in its structure. One is that the volumetric space at the top is generally unusable, and heating and cooling thereof is wasteful. Two, the bottom portion of the dome angles in at a sharp angle from the floor. The area immediately adjacent the bottom wall of a building structure is generally usable as a zone where a person can stand or sit, or for using the wall space for the hanging of decorative items, etc. This zone is a hemispherical dome structure is not easily usable for these purposes because the wall is at an angle to the floor.

SUMMARY OF THE INVENTION

In accordance with this invention, a minimum number of simple basic structural units are required to construct domical structures of varying sizes. The invention provides a domical-type construction wherein only four basic structural units are required. The units are isosceles triangles having predetermined thickness, dimensions, and edge angles on each side, whereby the units are mated together to form the structure.

Generally, the domical structure is constructed by arranging a floor level substantially perpendicular first tier or row of one basic triangular unit wherein the units alternate as upright and inverted units in a circular pattern. Similarly, a second canted tier atop the first tier comprises upright basic units of the first tier alternating with second inverted basic units. Similarly a third canted tier comprises upright second basic units alternating with third inverted basic units. The structure is closed at the top by a fourth tier of canted adjacent upright units arranged in a circular conical pattern and abutting the third tier of inverted units. The various abutting units are secured together along their edges angles. No internal support is required for the domical structure.

The design of the construction of the dome permits domes of varying floor diameters by merely increasing the size of the basic triangular units or by increasing the number of basic units in each tier.

DETAILED DESCRIPTION OF THE INVENTION

Figure 3:
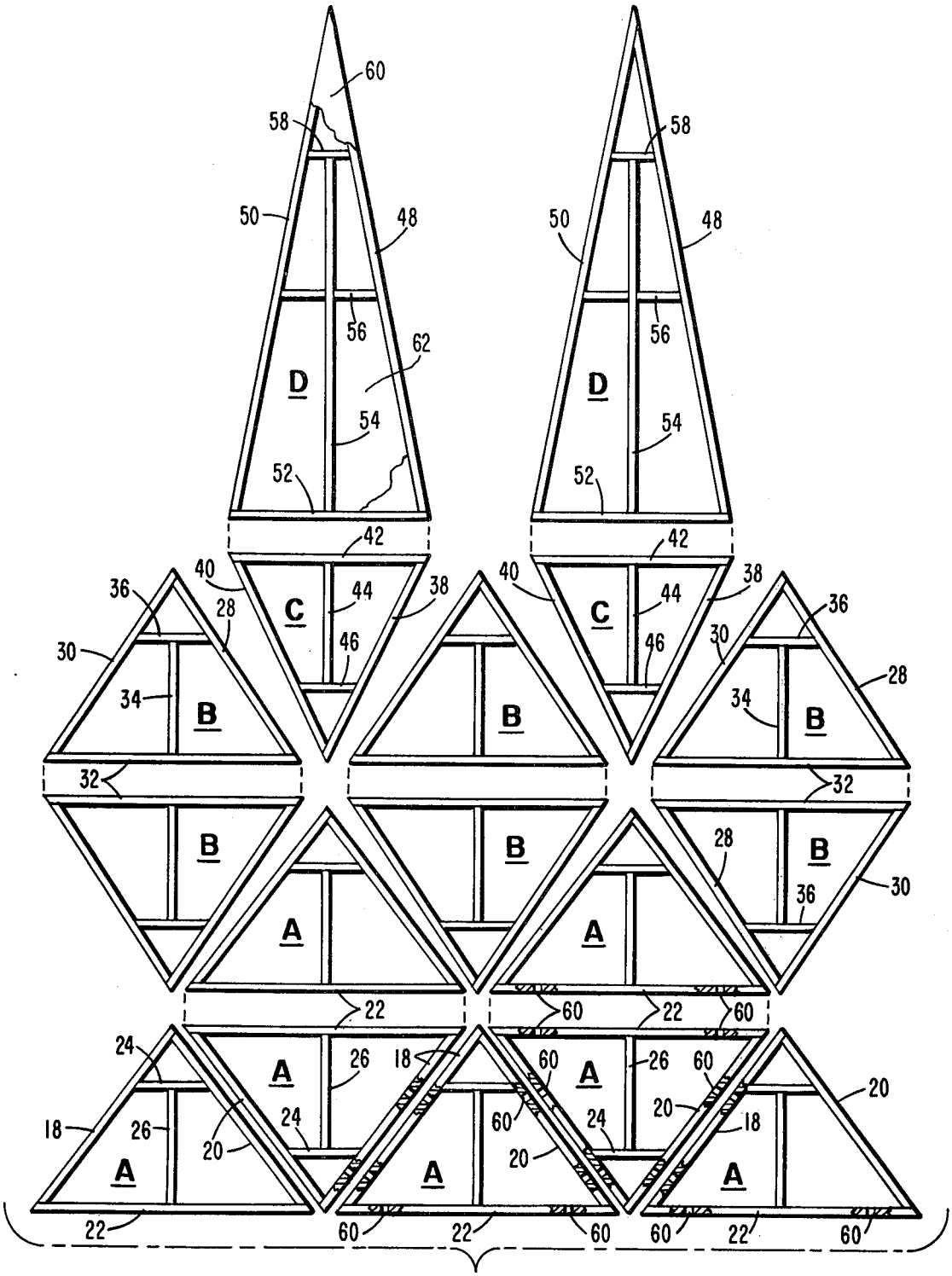
FIG. 3 is an exploded elevational view of the four basic structural units and their relationship to each other in the construction of the dome.
Figure 4:
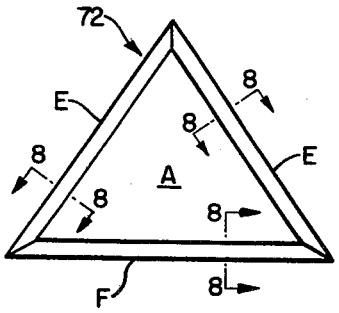
FIG. 4 is an inner view of the first structural basic unit labeled A, showing the edge angles and the dimensional lengths of each side thereof.
Figure 7:
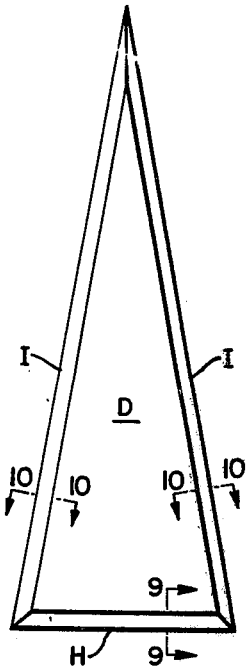
FIG. 7 is an inner view of the fourth structural basic unit labeled D, showing the edge angles and the dimensional lengths of each side thereof.
Figure 5:
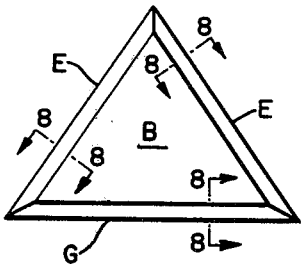
FIG. 5 is an inner view of the second structural basic unit labeled B, showing the edge angles and the dimensional lengths of each side thereof.
Figure 6:
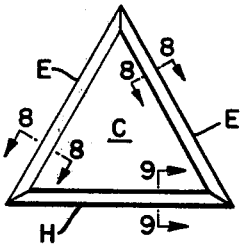
FIG. 6 is an inner view of the third structural basic unit labeled C, showing the edge angles and the dimensional lengths of each side thereof.
Figure 8:
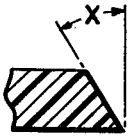
FIG. 8 is a view taken along line 8—8 of FIGS. 4, 5 and 6.
Figure 9:
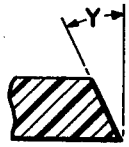
FIG. 9 is a view taken along line 9—9 of FIGS. 6 and 7
Figure 10:
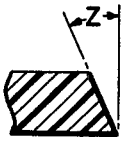
FIG. 10 is a view taken along line 10—10 of FIG. 7.

The four basic structural units of the invention used in constructing the domical structure can be designated as A, B, C and D as shown in FIG. 3. Each basic unit is an isosceles triangle having having outer and inner surfaces, a predetermined thickness and predetermined lengths for the equal and third sides. Each side edge of the units is bevelled or angled inwardly from the outer surface and this edge angle is predetermined for each of the basic units, the purpose being that abutting or adjacent units in the upward curving structure of the dome will correctly mate together at the edge interfaces of each unit, whether they are the same basic unit or not.

Figure 1:
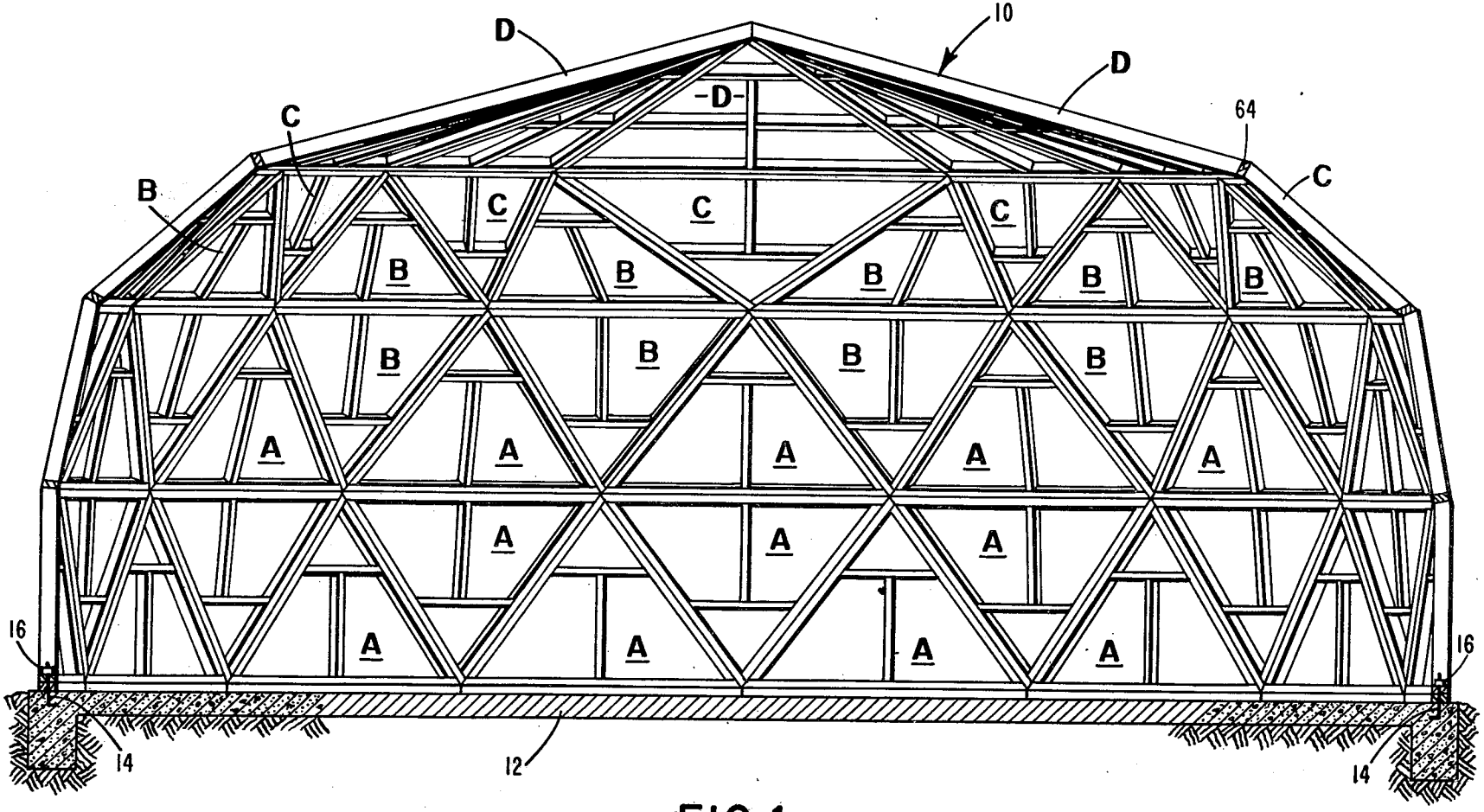
FIG. 1 is a vertical sectional view through the center of a circular dome constructed in accordance with this invention.
Figure 2:
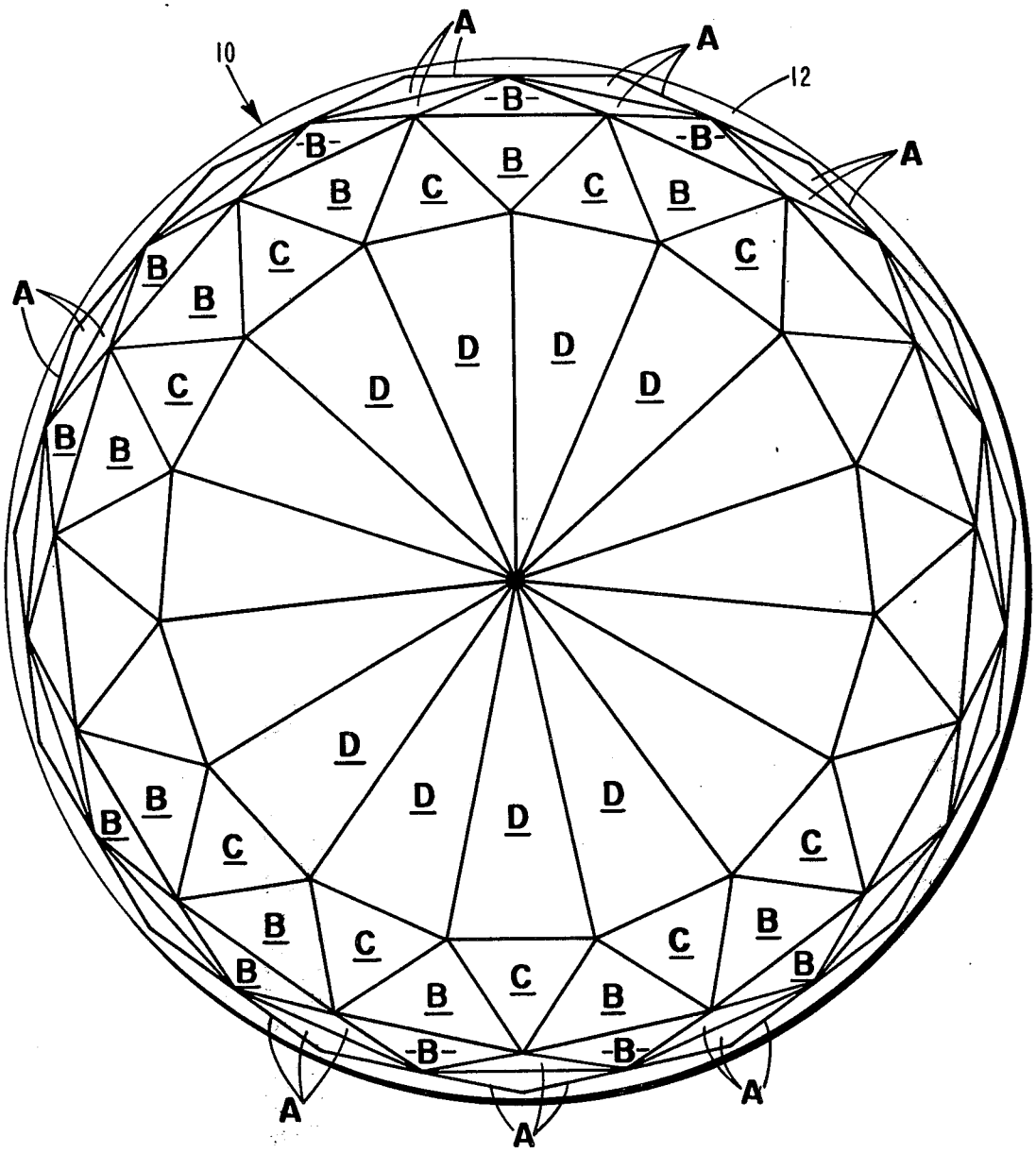
FIG. 2 is a schematic top plan view of the dome of FIG. 1.

As shown in FIG. 1, the domincal structure is constructed by erecting a first circular, substantially perpendicular tier or row of angularly abutting alternating upright A and inverted A units. The upright units are secured to a ground level foundation of concrete or the like as will be described hereinafter. Adjacent upright and inverted units are secured together along adjacent equal sides of the units. The alternating upright and inverted A units angle inwardly and outwardly to a small degree around the circular row. A second tier of alternating upright A units and inverted B units are installed with the angled third side of the upright A units of tier two abutting the angled third side of the inverted A units of the first tier. The second tier is therefore canted inwardly from one an amount equal to the edge angle of unit A.

A third tier is similarly installed as the second tier comprising alternating upright B units and inverted C units with the angled third side of the upright B units of the third tier abutting the angled third side of the inverted B units of tier two. The third tier is therefore also canted inwardly from tier two an amount equal to the edge angle of unit B.

The top of the domical structure is enclosed by installing a fourth tier of upright units D all angularly abutting each other along their equal sides to form a conical top with the apexes of each unit meeting at the top of the dome. The angular third sides of units D abut with the angular third sides of upright units C in tier three. The fourth tier is canted inwardly from the third tier by an amount equal to the edge angle of unit D. The cantation can be varied, as desired, by changing the edge angle of the third side of unit D to provide a higher or lower top to the dome.

Dimensional, predetermined interrelationships exist between A, B, C and D units. Units A, B, and C each have the same lengths E on their respective equal sides, however unit A has length F, unit B has length G and unit C has length H on their respective third sides. Both units A and B each have the same edge angle X on all three sides, whereas unit C has edge angle X on the equal sides but edge angle Y on the third side. Unit D has lengths I and edge angle Z on its equal sides, and length H and edge angle Y on the third side. FIGS. 4–10 illustrate typical units A, B, C and D showing their edge angles, and dimensional lengths on their equal and third sides.

The dimensions of the four basic units are determinant on two, not necessarily dependent, factors. One factor is the desired diameter of the base of the structure. The second factor is the desired planar surface size of each of the four basic units. When a dome of a particular base diameter is desired, the four basic units can be manufactured of a larger or smaller planar size. A greater number of smaller planar size units would be required than larger units to construct the first tier of the units. Accordingly, the lengths of the third sides and edge angles of the units would be dependent on the number of units required to form a circle, with each edge angle of each unit providing an increment angle in the circle. It is to be noted, however, that once a set of predetermined calculations are made for a dome having a desired diameter, the base diameter of the dome can be increased or decreased by proportionally reducing the planar size of the triangular units, whereas the edge angles remain constant. In determining the planar size of the basic units in any desired base diameter of the structure, consideration should be given to the dimensions of the first and second tiers of the units. Thus, the invention provides that the first tier be substantially perpendicular with the second tier being canted to the first by a predetermined degree. In this regard, the space and floor area near the first and second tiers should all be substantially usable to the edge of the perimeter. Thus, in predetermining the dimensions of the first and second tiers of triangular units, their combined height should desirably be 7–8 feet, which is the desired height of walls in conventional housing construction. Therefore, in predetermining the edge angles of the basic units, the diameter of the dome and the dimensions of the units are mainly determinant in calculating the edge angles of the units in the first and second tiers, wherein the planar heights of the units are fixed to provide an inner surface wall of 7 or 8 feet high. Thus, a dome of larger floor diameter would require a greater number of basic units with smaller edge angles in the first and second tiers, whereas a smaller floor diameter would require fewer basic units with larger edge angles.

The basic units A, B, C and D of the invention based on the above stated dimensional relationships, are predetermined with respect to each other as follows. With a desired floor diameter of the dome and a first and second tier height about 7 or 8 feet high, the number of upright A units required to form the first tier is obtained by determining the circumference of the dome at its base. From the circumference, the dimension of the third side of A unit is determined to provide a sufficient number of upright A units which will circle the circumference in the first tier. In determining the third sides, consideration is given to the height of the triangle to obtain a structurally strong unit. From the number of upright A units required, the edge angle of the A units is determined as follows:

$$\frac{360}{2(\text{no. of upright A units in first tier})}$$

Accordingly, the dimension of the third side and edge angle of A unit will be determined with the height being preferably about four feet. Since upright A units are used in the second tier, this will provide an inner substantially perpendicular wall of about 8 feet high. The equal sides of the A unit can be calculated from the third side dimension and its height.

The side dimensions and edge angles of the B units can then be determined from the above recited relationship between A and B units. Thus A and B units have the same lengths of equal sides and the edge angles are the same in both. The third side of B unit will be less than the third side of A unit and can be determined by the distance between the apexes of two canted upright A units in tier two.

Similarly, the side dimensions and edge angles of C units can be determined. C units have the same lengths and edge angles on their equal sides as units A. With respect to their third side of C unit, the length is determined by the distance between the apexes of two canted, upright B units in tier three. The edge angle of the third side of C unit is determined by the amount of cantation desired in units D.

The side dimensions and edge angles of units D are determined from the desired cantation of the fourth tier to enclose the dome. The length of the third side of unit D is the same as the third side of unit C. When the desired cantation of tier four is determined, the length of the equal sides of unit D is the distance from the apex of a unit B in tier three to the center top of the dome. The edge angles of the equal sides of unit D are dependent on the cantation and the number of D units in tier four.

The dome-type structure described above is not a true dome, i.e. a hemisphere. Because of the predetermined cantation of the upper tiers of the structure, a stable structure is present and a spherical surface is not necessary as is the case in geodesic-type domes. Accordingly, the unique construction of the invention provides a structure which has a center height which is less than the radius of the circular base. Thus, less space is present in the upper part of the dome of this invention than is present in a true geodesic-type dome. Correspondingly less space reduces the heating and cooling requirements of the dome.

The following is a detailed description of an embodiment of a domical construction according to this invention, having a diameter of 30 feet, wherein four basic triangular units are used having predetermined equal and third sides, and edge angles. The triangular units are constructed from 2×4 plywood strips with the broad side providing the thickness to the unit. Dimensions of the units hereinafter stated, refer to the larger planar surface of each unit. The thickness of the triangular units can vary depending on the materials of construction and the desired thickness needed. Generally, thickness of about several inches up to about a foot are suitable.

Referring to the drawings, the reference numeral 10 designates a skeletal dome structure in FIG. 1 which is constructed using the basic triangular structural units A, B, C and D shown in FIG. 3.

Unit A of tier one comprises equal sides 18 and 20 and third side 22. The unit is strengthened by struts 24 and 26. The equal sides 18 and 20 are 60 inches in length with third side 22 being 74 inches. Each side 18, 20 and 22 has an edge angle 12° with respect to the plane of the triangle. Adjacent upright and inverted A units are mated together at the edge sides in each tier.

In the second circular tier, upright A units alternate with inverted B units. Unit B comprises equal sides 28 and 30, third side 32, and struts 34 and 36. The equal sides 28 and 30 are 60 inches in length with third side 32 being 67¾ inches. The edge angle of all three sides of B unit is 12°.

In the third circular tier, upright B units alternate with inverted C units. Unit C has equal sides 38 and 40, third side 42, and struts 44 and 46. The equal sides 38 and 40 are 60 inches in length with thid side 42 being 53½ inches. The edge angles of C units are 12° along the equal sides 38 and 40 and 12° for third side 42.

The fourth tier comprises upright D units all arranged in a circular pattern forming a conical structure which encloses the dome at the top. Unit D comprises equal sides 48 and 50, third side 52, and struts 54, 56 and 58. The equal sides 48 and 50 are 11 feet 4 inches with third side 52 being 53½ inches. The edge angles of D units are 10° along equal sides 48 and 50 and 15° along side 52.

The dome is constructed by installing units A in the first tier. The upright units A are each successively secured to a ground foundation 12 by means of anchor bolts 14 passing through holes in side 22 of unit A and secured by nuts 16. The inverted units A are successively installed between the upright A units to form the circular first tier. The upright units A installed substantially perpendicularly on the foundation with the edge angle of side 22 being adjusted by shims or inserts and the like to assure a substantial perpendicularity to the unit. Alternating upright and inverted units A are secured together by suitable means. Thus the sides 28, 30, and 32 can have holes 60 through which nuts and bolts (not shown) can be inserted. Similar fastening means are employed throughout the structure.

The second tier of alternating upright A and inverted B units are installed with the third side of upright A units angularly abutting the third side of inverted A units in tier one and secured similarly. The second tier, because of the mating edge angles of inverted A units in tier one and upright A units in tier two will be angled or canted inwardly from the perpendicular by 12°. The vertical height of unit A is about four feet and unit B is about four feet, two inches. The combined vertical height of tiers one and two provides a substantially perpendicular wall of about eight feet on the inside surface of the dome, thereby permitting all usable floor space within the circumferential confines of the dome structure.

The third tier of alternating upright B units and inverted C units are installed similarly as the first and second tiers and secured similarly with the third side of upright B units regularly abutting the third side of the inverted B units of tier two. The third tier is also canted inwardly about 12°

Units D in the top tier of the dome are installed with the third sides of D units abutting the third sides of inverted C units in tier three. In this tier, units D angularly abut each other on their respective equal sides 48 and 50 to form a conical top structure. In the construction of the above dome structure, 45 A units, 30 B units, 15 C units, and 15 D units are required.

The completed skeletal structure can be covered with a variety of lightweight materials, for example, canvas, plastic materials, plywood panels, etc., such as is shown at 60 and 62 on a D panel in FIG. 3. Preferably when panels of plastic or plywood are used to cover each outer face of units A, B, C and D, the seams between them can be covered with a weatherproof tape or filling materials to provide a continuous weatherproof outside surface as is shown at 64 in FIG. 1.

Figure 11:
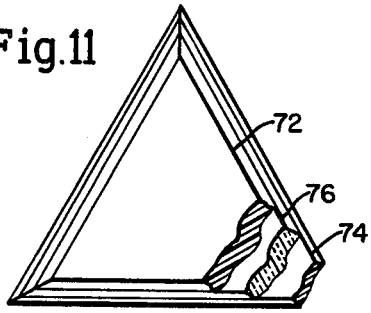
FIG. 11 is an inner view with portions exposed of a typical basic structural unit showing an insulating core material sandwiched between outer panels.

Although the above embodiment has been described with the basic structural units comprising a skeletal wood construction, the basic units can be made of triangular panels of wood having an insulating material such as plastic foam therebetween. Furthermore, the basic units can be a suitable solid molded plastic material as shown in FIGS. 4–10 or plastic panels 72 and 74 with an insulating core material 76 such as polyurethane, polystyrene, fiberglass, etc. sandwiched therebetween as shown in FIG. 11. The basic units can also be fabricated of fiberboard, corregated fiberboard, fiberglass, metal such as aluminum or any rigid flat material. In addition, the materials of construction can be constructed as sandwich panels 66 and 68 as shown with a B panel in FIG. 3 having an insulating material 70 therebetween.

In the erection of the dome, the units instead of being bolted together can be welded or bended together, the abutting surfaces can be tongue and grooved, etc.

The above embodiment is illustrative of one size dome that can be constructed from the basic units, i.e. a 30 foot diameter dome having a height of 14 feet, 4 inches. Larger diameter domes can also be constructed by increasing the number of triangles in each tier by increments of two units in each tier, however, in so doing, the edge angle must be decreased a predetermined amount as described heretofore to compensate for the greater number of units in the circumference of each tier. Alternatively, the larger dome can be constructed by increasing the dimensions of each basic unit proportionally.

One particular advantage of the dome construction of this invention is that the height at the center is less than the radius of the circumferential base and is thus not a true spherical structure. The advantage, therefore, is that less unused volume at the top of the dome is present, which would normally require heating or cooling.

The invention provides a strong symmetrical, domical structure having substantially uniform expansion of all the component units. Erection of the structure is simple, wherein one or two men can easily assembly the units in place in a minimum amount of time.

The basic units can be manufactured to provide doors in combinations of units A and B of tiers one and two.

Furthermore, skylights can easily be provided in units D and windows in units A, B or C.

From the foregoing description, one skilled in the art can easily ascertain the essential characteristics of this invention, and without departing from the spirit and scope thereof, can make various changes and modifications of the invention to adapt it to various usage and conditions.

What is claimed is:

1. A circular domical type structure constructed from four basic triangular, rigid structural units A, B, C and D, wherein each structural unit is an isosceles triangle having a predetermined desired thickness, a planar outer surface, an inner surface, and predetermined dimensional lengths for the equal and third sides, and wherein each of said equal and third sides of said triangular unit have a predetermined acute edge angle as measured inwardly from the plane of said outer surface; said four basic units being interrelated in their respective dimensional side lengths and acute side edge angles; said units A, B, C and D each having the following dimensional side lengths:

a. units A, B, and C have lengths E on their equal sides, b. unit A has third side length F, unit B has third side length G, units C and D have third side length H, and unit D has length I on its equal sides;

said units A, B, C and D each having the following acute side edge angles:

c. units A and B have edge angles X on all three sides and unit C has edge angle X on the equal sides;

d. units C and D have edge angles Y on the third sides, e. unit D has edge angle Z on its equal sides; said structure comprising a first circular tier of substantially perpendicular alternating upright and inverted A units, wherein said equal sides E of said alternating upright and inverted A units abut and mate with each other along said equal side edge angles X of each unit thereof, and said outer planar surfaces of each of said alternating units cant inwardly and outwardly; an inwardly canted, second circular tier of alternating upright A units and inverted B units, wherein said third sides F of upright A units of said second tier abut and mate with said third sides F of said inverted A units of said first tier along said third side edge angles X of each unit thereof, and wherein said equal sides E of said upright A units abut and mate with said equal sides E of said inverted B units along said equal side edge angles X of each unit thereof; an inwardly canted third circular tier of alternating upright B units and inverted C units, wherein said third sides G of said upright B units abut and mate with said third sides G of said inverted B units of said second tier along said third side edge angles X of each unit thereof, and wherein said equal sides E of said upright B units abut and mate with said equal sides E of said inverted C units along said equal side edge angles X of each unit thereof; an inwardly canted fourth circular tier of upright D units which form a conical top for said structure and which abut and mate with said inverted C units of said third tier along said third side H and said third side edge angles Y of each unit thereof, and wherein said equal sides I of said upright D units abut and mate with adjacent equal sides I and equal side edge angles Z of each unit thereof; said edge angle X and the number of said A units in said first circular tier are determined by the selected radius of the basic of said structure and the selected dimensional third side lengths F of the A units; said structure having a center height which is less than the radius of said first circular tier of structural A units, wherein said center height is determined by the selected dimensional equal side length E and the selected side edge angle Y; said edge angle Y being determinant of said inward cantation of said fourth tier of D units, whereby said edge angle Y is selected to obtain a desired inward cant which produces a center height which is less than the radius of said first circular tier of structural A units.

2. The structure of claim 1, wherein said structural units have a skeletal structure and the structure is covered on the outer surface with a weatherproof material.

3. The structure of claim 1 wherein said structural units are a solid material of construction.

4. The structure of claim 1, wherein said structural units comprise an insulating core material sandwiched between outer panels.

5. The structure of claim 1, wherein said first and second tiers of structural units have a height of about 7–8 feet.

6. The structure of claim 1, wherein said abutting panels include a sealing means to provide a smooth outer surface.

* * * * *